US007573371B1

(12) United States Patent
Miller

(10) Patent No.: US 7,573,371 B1
(45) Date of Patent: Aug. 11, 2009

(54) ALARM SYSTEM FOR DEMENTIA PATIENTS

(76) Inventor: Tony Miller, 4204 Rachel Donelson Pass, Hermitage, TN (US) 37076

( * ) Notice: Subject to any disclaimer, the term of this patent is extended or adjusted under 35 U.S.C. 154(b) by 301 days.

(21) Appl. No.: 11/591,841

(22) Filed: Nov. 2, 2006

(51) Int. Cl.
*G08B 1/00* (2006.01)
*G04F 8/00* (2006.01)

(52) U.S. Cl. ..... 340/309.16; 340/309.7; 340/691.1; 340/691.6; 368/1; 368/10; 368/244

(58) Field of Classification Search ..... 340/309.16
See application file for complete search history.

(56) References Cited

U.S. PATENT DOCUMENTS 4,070,697 A 1/1978 Miller et al. ..... 360/12
4,302,752 A 11/1981 Weitzler ..... 340/309.1
5,088,056 A 2/1992 McIntosh et al. ..... 364/569
5,365,494 A 11/1994 Lynch ..... 368/10
5,708,627 A 1/1998 Gormley ..... 368/10
6,075,755 A * 6/2000 Zarchan ..... 368/10
6,301,196 B1 10/2001 Daniel ..... 368/10
6,626,358 B1 9/2003 Breimesser et al. ..... 235/380
6,831,568 B1 12/2004 Cortopassi et al. ..... 340/815.4
6,967,900 B2 11/2005 Chapman ..... 368/10

* cited by examiner

*Primary Examiner*—Donnie L Crosland
(74) *Attorney, Agent, or Firm*—Waddey & Patterson, P.C.; Lucian Wayne Beavers; Dennis H. Núñez

(57) ABSTRACT

An alarm system is designed to remind individuals, specifically individuals suffering from memory related diseases, of scheduled events and appointments. The device utilizes a digital scheduling device, such as a personal digital assistant (PDA), to input messages to be communicated at a scheduled time. The message is communicated via a set of speakers either directly or indirectly connected to the digital scheduling device.

30 Claims, 3 Drawing Sheets

ALARM SYSTEM FOR DEMENTIA PATIENTS

BACKGROUND OF THE INVENTION

The present invention relates generally to an alarm system for reminding an individual of scheduled events and appointments.

More particularly, this invention pertains to an alarm system to help remind individuals suffering from memory related diseases.

Systems for reminding individuals of scheduled events are well known in the art. For example, U.S. Pat. No. 6,831,568 discloses a personal digital assistant (PDA) which inserts into a cradle. The personal digital assistant is utilized to store certain scheduling information. At the time of the scheduled event the cradle contains a simple alarm which provides a visual blinking signal in addition to a typical alarm sound signal, such as a buzzing sound.

Another prior art embodiment, U.S. Pat. No. 5,088,056, contains a control program including a program timer which determines the time when dosages of medication are to be taken from a pillbox. Upon reaching the scheduled time, a simple alarm is rung in order to remind the individual to take a particular medication.

None of the prior art systems, however, teaches a system which actually communicates a message to the user about a particular appointment or medical event. All of the prior art systems simply contain simple alarms which send blinking signals or buzzing sounds or do not contain a separate device such as a docking unit dedicated to the communication of the message to the patient. Particularly, no device utilizes a digital scheduling unit, such as a personal digital assistant to assist a dementia patient with medical appointments and medical events.

What is needed, then, is a system which contains a unit for the communication of messages to a dementia patient. In this manner, the capabilities of a digital scheduling unit, such as a PDA, can be maximized to assist persons suffering from memory diseases.

BRIEF SUMMARY OF THE INVENTION

As described in detail in this application, the invention has several features which can assist patients dealing with memory problems. The device contains a docking unit which docks a digital scheduling unit and connects the scheduling unit to attendant devices through a data port. The device also contains a memory device and a microprocessor wherein the message inputted from the digital scheduling unit is stored in the memory device. At the scheduled time, the microprocessor causes the transfer of the message to a messaging device which communicates the message. The communication of the message thus directly alerts a dementia patient of the scheduled task to be performed.

Accordingly, one object of the present invention is to remind persons with memory diseases of scheduled appointments or events.

Another object of the present invention is to provide a device which reminds a person of a scheduled event by actually communicating a message.

Yet another object of the present invention is to utilize the scheduling functions of a digital scheduling unit, such as a PDA, to remind persons of scheduled events.

Still another object of the present invention is to provide a system for communicating a message about a scheduled event which can communicate the message remotely to messaging devices not positioned at the actual scheduling device.

Still another object of the present invention is to verbalize a message to a person suffering from a memory disease so that they may be reminded of the specific task to be performed.

Yet another object of the present invention is to remind a person to take a medicine at a scheduled time.

DETAILED DESCRIPTION OF THE INVENTION

Figure 1:
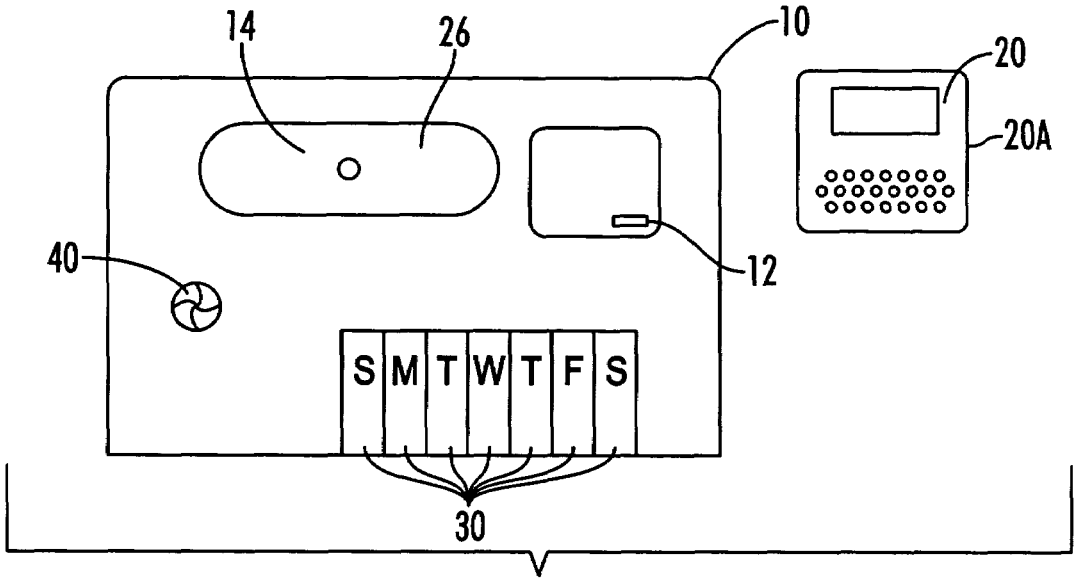
FIG. 1 is a top view of one embodiment of this invention with a docking unit.
Figure 2A:
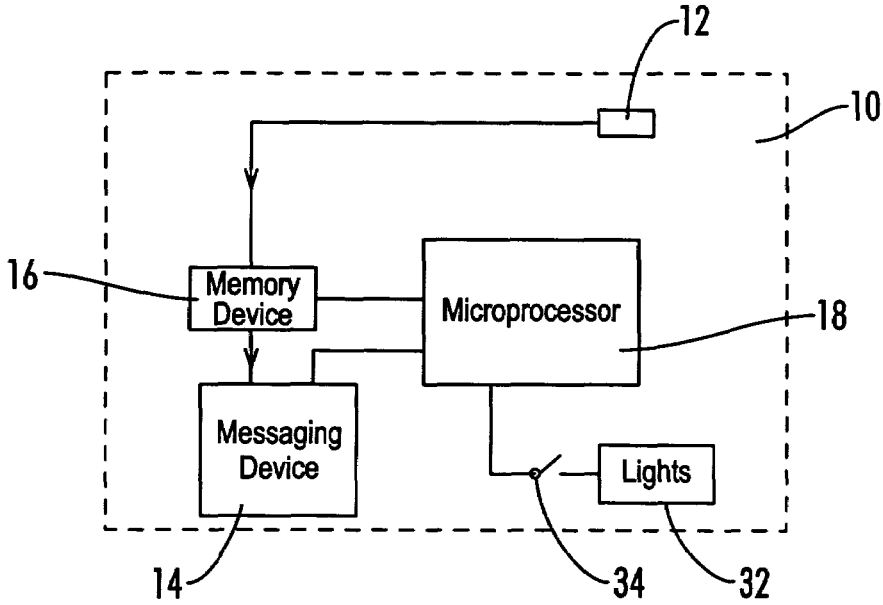
FIG. 2A is a block diagram of one embodiment of the present invention wherein the microprocessor and the memory device are contained within the docking unit.
Figure 2B:
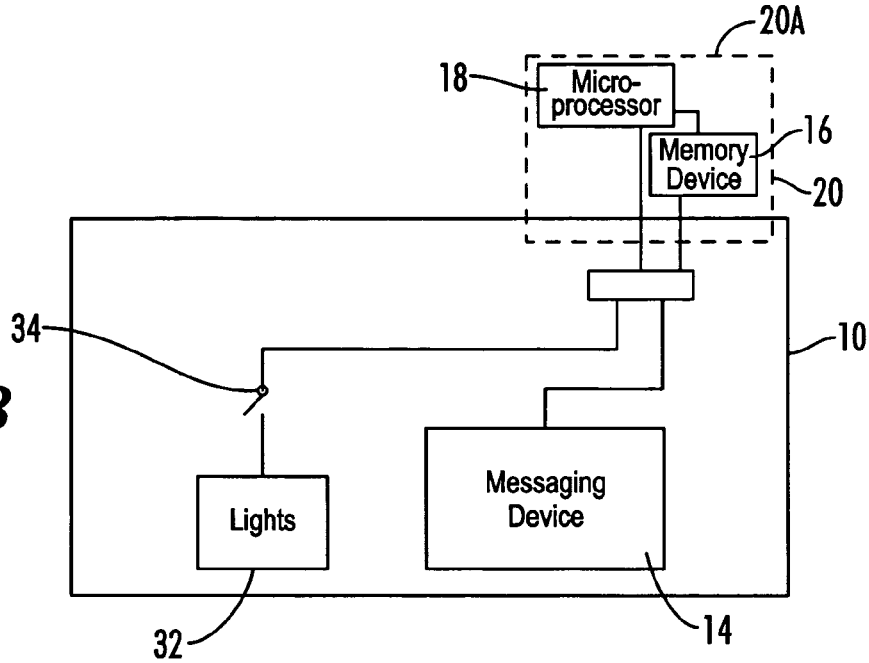
FIG. 2B is one embodiment of the present invention wherein the microprocessor and the memory device are contained within the digital scheduling unit.

Referring now to FIGS. 1, 2A and 2B, the device contains a docking unit 10 having a data port 12. The data port 12 may be any port suitable for the transfer of data. Such ports include a 6 mini DIN female port, a 5 DIN female port, a 4 mini DIN port, a DB9 or DB 15 female or male port or a USB port. The device also contains a messaging device 14 which in this case is a speaker 26. A digital scheduling unit 20, which in the diagram is a personal digital assistant 20A, inputs a message for communication at a scheduled time. While the figure shows a personal digital assistant 20A, any digital unit having the capability of inputting messages for communication at a scheduled time is suitable. Thus, the digital scheduling unit 20 may be a digital device specifically designed to input the information required by the system. The digital scheduling unit 20 docks within the docking unit 10 thereby connecting the scheduling unit 20 to the data port 12. The message is transferred from the digital scheduling unit 20 through the data port 12 to a memory device 16. The microprocessor 18 provides this functionality. At the scheduled time, the microprocessor 18 causes the transfer of the message from the memory device 16 to the messaging device 14 which communicates the message.

Referring now specifically to FIGS. 2A and 2B the microprocessor 18 may be contained within either the digital scheduling unit 20 or the docking unit 10. Normally, if the microprocessor 18 is contained within the digital scheduling unit 20, the device will be a personal digital assistant 20A. The microprocessor 18 will thus likely be a general purpose microprocessor. The personal digital assistant will come equipped with a software program for storing a schedule with the message and for causing the transfer of the message from the memory device 16 to the messaging device 14, as shown in FIG. 2B. However, the microprocessor 18 may also be contained within the docking unit 10. In this situation, the microprocessor 18 is likely to be a microcontroller specifically designed to perform the functions required by the system. As shown in FIG. 2A, the microcontroller will cause the transfer of the message to the memory device 16 and ultimately to the messaging device 14 for communication to the patient.

Figure 3:
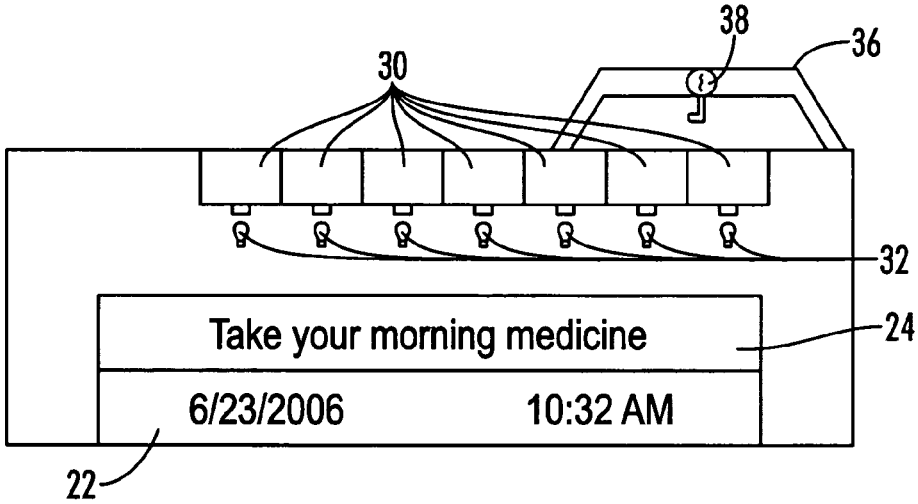
FIG. 3 is a front view of an embodiment of the present invention having a display for textually representing a message.

Referring now to FIG. 3 the messaging device 14 may comprise a display 22 which communicates the message through text 24. As previously mentioned and referring again to FIG. 1, the messaging device 14 may also comprise a speaker 26 for verbalizing the message. Thus, the messaging device 14 actually communicates the information to the patient, as opposed to simply buzzing or blinking an alarm without providing information about the reason for alerting the patient. The microcontroller 18 may format the message for communication to the specific messaging device 14. For example, if the messaging device 14 is the display 22, the microcontroller may contain functionality for formatting the message into ASCII. Alternatively if the messaging device 14 is the speaker 26, the microprocessor may be configured to turn digital audio information into analog signals for a speaker. Alternatively, the microprocessor 18 may be controlled by a software program in either the digital scheduling unit 20 or a separate memory device containing processor instructions.

Figure 4:
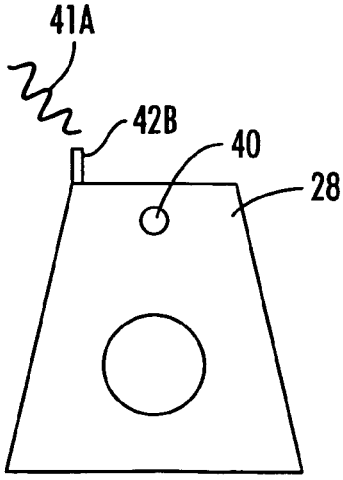
FIG. 4 is a front view of a remote speaker.

The alarm system may comprise a wireless remote speaker 28, as shown in FIG. 4. This provides important functionality to the system. In this manner, the message may be communicated in various locations thereby reminding the patient of the scheduled event regardless of his location in the home or in the hospital. An electromagnetic signal 41A carrying the messaging information will be transmitted to a receiver 42B connected to the remote speaker 28. Thus, the alarm system is not only designed to remind a person of a scheduled event, but to surround a person's living space with reminders of appointments. The remote speaker 28 verbalizes the message such that the person is notified of an appointment regardless of their location.

Referring again to FIG. 1, the docking unit 10 may further comprise one or more pillboxes 30. These pillboxes 30 will contain one or more medicines to be taken at a specific time by a patient. The digital scheduling unit 20 will thus be configured to input a message which informs when to take one or more medicines within the pillboxes 30. Each pillbox 30 may correspond to a day of the week so that a user will remember to take specific medicines at particular times during the week. Each pillbox 30 may thus be color coded to indicate the day of the week to take the medicine. In the alternative, referring to FIG. 3, the docking unit 10 may further comprise a light 32 under each pillbox 30 wherein the light 32 illuminates the pillbox 30 with the appropriate medicine. In this manner, the inconvenience of regularly keeping up with a patient's medicine schedule is eliminated.

Referring now to FIGS. 1 and 3, the device may have a protective cover 36 and a locking mechanism 38 thereby preventing the digital scheduling unit 20 from being disabled by an incoherent or frightened patient. Furthermore, the alarm system may have a flashing light 40 which flashes at a scheduled time. The flashing light 40 may be included within the docking unit 10. Alternatively the flashing light may be included within the remote speaker 28 as shown in FIG. 4. The flashing light illuminates at the scheduled time to assist the hearing impaired and to compensate for other noises in the room such as television and radio.

Another feature of the present invention is that the message can be inputted remotely via e-mail. Digital scheduling units 20, such as PDAs, often come equipped with devices capable of connecting to the Internet, internets or extranets via WIFI or wireless wide area networks. Furthermore a PDA may synchronize data with a contact database, such as Microsoft Outlook or ACT!, hosted on personal computers or company servers. The PDA thus serves as a window to a host computer. Thus, persons such as family members or doctors may set appointment times and schedule medical treatment via the capabilities of the personal digital assistant.

Figure 5:
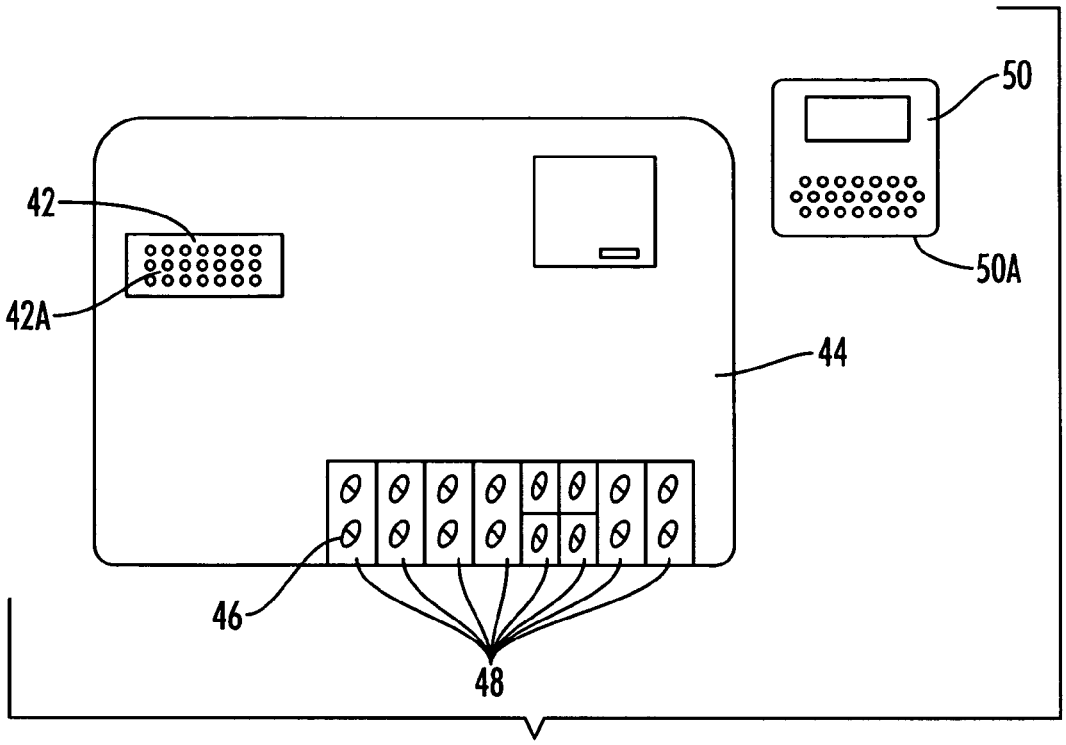
FIG. 5 is a top view of a second embodiment of this invention containing an alarm and a set of pillboxes.

Referring now to FIG. 5, a second embodiment of the invention is shown. This embodiment is specifically toward the provision of medicines from a pillbox 48. The alarm system has a reminding device 42. In this case, reminding device 42 is an alarm 42A. As used in this invention, reminding device 42 has a broader definition than messaging device 14. Messaging devices 14 actually communicates a message to a person. Instead, reminding devices 42 alert the user of a particular event. Thus while a reminding device 42 may be a messaging device 14 because a messaging device 14 also alerts a user of an event by communicating a message, the reminding device 42 may also simply be an alarm 42A, a buzzer, or a bell. In fact any device which has the ability to call the attention of a person qualifies as a reminding device. The embodiment also has a docking unit 44 including one or more pillboxes 48. As in the previous embodiments a digital scheduling unit 50 docks within docking unit 44 and inputs one or more scheduled times for taking one or more medicines 46 within the pillboxes 48. At the scheduled times, the docking unit 44 sends a signal to the reminding device 42 which causes the reminding device 42 to indicate when to take the medicines 46.

As previously explained, in FIG. 5 the reminding device 42 comprises an alarm. However, the reminding device may also be a display 22 as shown in FIG. 3 for textually communicating when to take the medicines 46 from the pillboxes 48. In addition, the reminding device 42 may also be a speaker for verbalizing when to take the medicines 46 from the pillboxes 48. As previously explained, the definition of reminding device 42 is broad enough to encompass all of these devices.

Referring again to FIG. 5 each pillbox 48 corresponds to a day of the week. The pillboxes 48 may be color coded for indicating which pills should be taken on a particular day of the week. Furthermore, as shown in FIG. 3, a light 32 may be placed under each pillbox 48 when the light illuminates the pillbox 48 from which to take the medicine 46. As shown in FIGS. 2A and 2B, these lights 32 may be controlled by the microcontroller 18. In the preferred embodiment, the microcontroller 18 controls a switch 34 for turning on a particular light 32.

Figure 6:
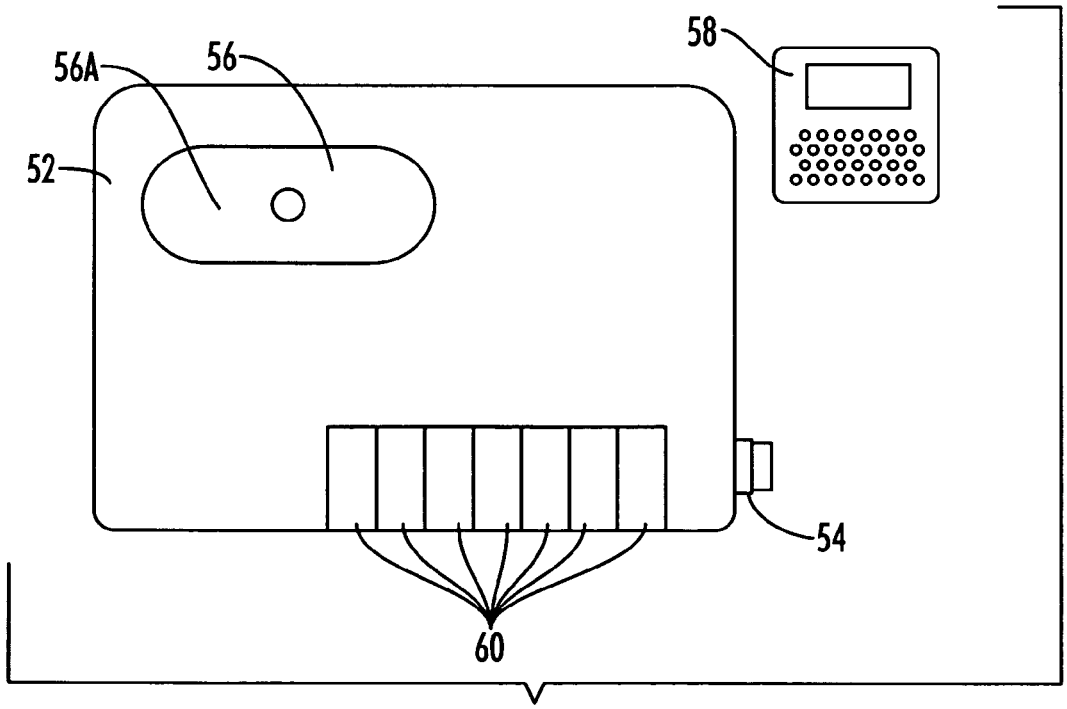
FIG. 6 is a top view of a third embodiment of this invention with a message transfer unit.

Referring now to FIG. 6, a third embodiment of the present invention is shown. This embodiment contains a message transfer unit 52 having a data port 54. Unlike the previous embodiments, the digital scheduling unit 58 does not dock in the message transfer unit 52 but instead is connected by a cable or other means. For example, the message transfer unit 52 may be connected to the digital scheduling unit 58 through wireless devices. As such data port 54 would be a receiver of electromagnetic information from the digital scheduling unit 58. The embodiment also contains a messaging device 56 which in FIG. 6 is shown as speaker 56A. The digital scheduling unit 58 inputs the message for communication at the scheduled time. The digital scheduling unit 58 is connected to the message transfer unit 52 through the data port 54 which transfers the message. As was shown in FIGS. 2A and 2B, the embodiment also contains a memory device 16 and a microprocessor 18 which perform the functions that were previously explained in the application.

Thus, although there have been described particular embodiments of the present invention of a new and useful Alarm System for Dementia Patients, it is not intended that such references be construed as limitations upon the scope of this invention except as set forth in the following claims.

What is claimed is:

1. An alarm system, comprising:

a docking unit having a data port;

a messaging device;

a digital scheduling unit which inputs a message for communication at a scheduled time and docks within the docking unit thereby connecting to the data port and which transfers a transmit signal and the message through the data port;

a memory device; and a microprocessor which receives the transmit signal and causes the message to be stored in the memory device wherein the microprocessor causes the transfer of the message at the scheduled time to the messaging device which communicates the message.

2. The alarm system of claim 1, wherein the messaging device comprises a display which communicates the message through text.

3. The alarm system of claim 1, wherein the messaging device comprises a speaker for verbalizing the message.

4. The alarm system of claim 3, wherein the speaker comprises a wireless remote speaker.

5. The alarm system of claim 3, wherein the docking unit includes the speaker.

6. The alarms system of claim 1, wherein the docking unit further comprises one or more pill boxes wherein the message informs when to take one or more medicines within the pill boxes.

7. The alarm system of claim 6, wherein each pill box corresponds to a day of the week.

8. The alarm system of claim 7, wherein each pill box is color-coded for indicating the day of the week.

9. The alarm system of claim 6, further comprising a light under each pill box wherein the light illuminates the pill box with the appropriate medicine.

10. The alarm system of claim 1, further comprising a protective cover having a locking mechanism thereby preventing the digital scheduling unit from being disabled.

11. The alarm system of claim 1, wherein the digital scheduling unit comprises a personal digital assistant.

12. The alarm system of claim 1, wherein the message can be inputted remotely via email.

13. The alarm system of claim 1, further comprising a flashing light which flashes at the scheduled time.

14. The alarm system of claim 13, wherein the docking unit includes the flashing light.

15. The alarm system of claim 13, wherein the messaging device includes the flashing light.

16. The alarm system of claim 1, wherein the microprocessor is contained within the digital scheduling unit.

17. The alarm system of claim 1, wherein the microprocessor is contained within the docking unit.

18. The alarm system of claim 1, wherein the microprocessor formats the message for communication by the messaging device.

19. An alarm system comprising:

a reminding device;

a docking unit having one or more pill boxes;

a digital scheduling unit which docks within the docking unit and inputs one or more scheduled times for taking one or more medicines within the pill boxes whereby the docking unit sends a signal to the reminding device at the scheduled times which causes the reminding device to indicate when to take the medicines.

20. The alarm system of claim 19, wherein each pill box corresponds to a day of the week.

21. The alarm system of claim 20, wherein each pill box is color-coded for indicating the day of the week.

22. The alarm system of claim 19, further comprising a light under each pill box wherein the light illuminates the pill box with the medicine to be taken at the scheduled time.

23. The alarm system of claim 19, wherein the reminding device comprises an alarm.

24. The alarm system of claim 19, wherein the reminding device comprises a display for textually communicating when to take the medicines from the pill boxes.

25. The alarm system of claim 19, wherein the reminding device comprises a speaker for verbalizing when to take the medicines from the pill boxes.

26. The alarm system of claim 19, wherein the digital scheduling unit comprises a personal digital assistant.

27. A method of reminding persons with memory deficiencies of scheduled events comprising:

inputting the scheduled event into a digital scheduling unit;

docking the digital scheduling unit within a docking unit;

sending message information about the scheduled event from the docking unit to a messaging device upon the occurrence of a scheduled event; and communicating the message information with the messaging device.

28. The method of claim 27, further comprising inserting one or more medicines within one or more pill boxes wherein the scheduled event comprises a time to take the medicines within the pill boxes.

29. The method of claim 27, wherein the messaging device comprises a remote wireless speaker.

30. The method of claim 29, wherein sending message information about the scheduled event from the docking unit to a messaging device, comprises:

transmitting an electromagnetic signal carrying the messaging information to the remote speaker; and receiving the electromagnetic signal at a receiver connected to the remote speaker.

* * * * *